US007191626B2

(12) United States Patent
Tittmann et al.

(10) Patent No.: US 7,191,626 B2
(45) Date of Patent: Mar. 20, 2007

(54) METHOD FOR PRODUCING AN INNER CONTOUR WITH AN INTERNAL ARBOR ACTING ON THE INSIDE WALL OF A WORKPIECE

(75) Inventors: Uwe Tittmann, Reinsdorf (DE); Matthias Schulten, Bad Düben (DE); Manfred Walther, Bad Düben (DE)

(73) Assignee: Profiroll Technologies GmbH, Bad Düben (DE)

( * ) Notice: Subject to any disclaimer, the term of this patent is extended or adjusted under 35 U.S.C. 154(b) by 0 days.

(21) Appl. No.: 11/146,996

(22) Filed: Jun. 7, 2005

(65) Prior Publication Data

US 2006/0272375 A1 Dec. 7, 2006

(51) Int. Cl.
*B21H 1/12* (2006.01)

(52) U.S. Cl. ..... 72/91; 72/67; 72/85; 72/125

(58) Field of Classification Search ..... 72/67, 72/84, 85, 86, 91, 112, 115, 117, 119, 125
See application file for complete search history.

(56) References Cited

U.S. PATENT DOCUMENTS

| | | | | |
|---|---|---|---|---|
| 6,076,387 | A * | 6/2000 | Siewert et al. | 72/69 |
| 6,145,362 | A * | 11/2000 | Piispanen et al. | 72/82 |
| 6,253,589 | B1 * | 7/2001 | Putz et al. | 72/85 |
| 6,269,670 | B2 * | 8/2001 | Koestermeier | 72/85 |
| 6,298,702 | B1 * | 10/2001 | Korte | 72/85 |
| 6,516,647 | B1 * | 2/2003 | Hirschvogel et al. | 72/67 |
| 6,959,576 | B2 * | 11/2005 | Hastings et al. | 72/91 |

FOREIGN PATENT DOCUMENTS

| | | |
|---|---|---|
| DE | 25 04 969 | 8/1976 |
| DE | 39 31 599 | 2/1991 |
| DE | 40 34 795 | 5/1992 |
| DE | 195 24 089 | 9/1996 |
| DE | 198 10 851 | 9/1999 |
| DE | 199 10 474 | 9/2000 |

* cited by examiner

*Primary Examiner*—Ed Tolan
(74) *Attorney, Agent, or Firm*—Collard & Roe, P.C.

(57) ABSTRACT

In the production of an internal contour with an internal arbor acting on the inner wall of a cup-shaped or annular rotationally symmetrical workpiece, expansion and length change of the workpiece are avoided during cold forming. Thus, gear components with internal teeth are produced that have greater symmetry and higher accuracy. A workpiece provided with a press fit on the outside or a prefabricated workpiece is inserted into the die, and during the cold forming is pressed tightly by friction and rotationally fixed with the rotationally driven internal arbor against the inner wall of the die. After completion of the rolling process of the profile, the workpiece is ejected with an axial ram. The internal arbor is provided with outside profiling and is cantilever-mounted and is fed axially and radially during the rolling.

8 Claims, 2 Drawing Sheets

METHOD FOR PRODUCING AN INNER CONTOUR WITH AN INTERNAL ARBOR ACTING ON THE INSIDE WALL OF A WORKPIECE

BACKGROUND OF THE INVENTION

1. Field of the Invention

The invention relates to a method for producing an inner contour on the inside wall of a workpiece with an internal arbor acting on the inside wall of the workpiece, which is cup-shaped or rotationally symmetrical. This method is especially useful for producing ring gears, slip bushings, ratchet bushings, couplers, or gear components provided in the same way with internal gearing. The workpieces are carried by a die that works together with the internal arbor during the cold forming.

2. The Prior Art

The production of rotationally symmetrical workpieces by cold forming is especially economical for highly stressed parts. To do this, an internal arbor whose circumferential surface corresponds to the internal profile after deformation is introduced into the formed part. On the one hand, this produces better strength characteristics resulting from material hardening and fiber structure during the deformation. On the other hand, the shape change necessary for the deformation is relatively slight, so that the work material retains sufficient toughness.

According to German Patent No. DE 199 10 474 A1, a hub sleeve is made by a rolling process or by a stamping process, in which the base part to be rolled does not undergo a length change. The deformation during the roller-pressing occurs principally in the radial direction. It is necessary to adapt the diameter ratios of the base part to the finished workpiece if the finished hub sleeve including the ball bearing race and knurl is to ensue without tilting the rolling of the tool.

To produce inside gearing for ratchet lock mechanisms, a negative impression of the gearing is machined into the profile on the internal arbor. The system shows an outer roller as a hollow cylinder with an internal profile, within which is located the internal arbor with its second profile, with the base part being roller-pressed by advancing against the outer roller. The advantage of the arrangement of an outer roller as a hollow cylinder with an internal arbor lies in the more stable rolling kinematics with a lengthened roller-pressing path, by which the base part is stabilized during the roller-pressing process and can be rolled without additional stabilizing aid.

Besides the rolling of teeth, the rolling of internal threads is known; it is carried out by rolling a rolling tool with a threaded roller. According to German Patent No. DE 40 34 795 C2, internal threads are produced in tubular workpieces with a tool with a helical working surface. The material is displaced from the thread base by the forming tool. With this method of deformation, very high pressures and frictional forces occur that increase sharply with increasing speed. This leads to rapid tool wear and to stripping of the threads on the workpiece. Rolling of internal threads requires a certain wall thickness and is thus unsuitable for sheet metal, for example.

For this reason, compression methods are used mainly when machining sheet metal workpieces, with the internal contour being imaged on a compression mandrel and the outer contour of the workpiece being imaged in a die. In German Patent No. DE 195 24 089 C1, a cup-shaped tool is used to produce a gear component with outer teeth. The metal blank rotating in the die is reduced in thickness with a compression roller by pressing from the center to the edge, and the material thus obtained is deformed to a cylindrical edge area projecting from the hub. The cylindrical edge area extending essentially perpendicular to the hub surface is provided with teeth on the outside.

In the production of an internally toothed gear component with a smooth outside according to DE 39 31 599 A1, a cup-shaped unmachined part is used that has been made either on a compression machine or a press. The unmachined part is located on a toothed compression mandrel and work is done on the rotating workpiece by means of a compression roller. In a first operating step, the workpiece is placed against the outer circumference of the compression mandrel provided with outside teeth, and in a second operating step the rotating cup-shaped workpiece is pressed by a compression roller into the grooves of the teeth, and is thereby lengthened at the same time.

The roller-pressing processes known from the state of the art for producing an inner contour have the drawback that the inner contour of the die is larger than the outer contour of the workpiece. The arbor roller for rolling the inner contour is substantially smaller than the inner contour of the workpiece. The rolling of the internal profiles is therefore associated with expansion of the unmachined part, which is disadvantageous for exact reproduction of gearing. When the rolling arbor and the die are driven at the same time, both have to have the same circumferential speed in the contact area with the workpiece. Also, material flow in the axial direction can be distinguished during the profile rolling, by which the workpiece becomes longer during the rolling, during the rolling process, corresponding to the volume of material displaced by the tool profile. When fabricating rings with large and deep profiles in gear rings or ratchet bushings, this leads to problems with the desired accuracy.

SUMMARY OF THE INVENTION

It is therefore an object of the invention to avoid the drawbacks of the state of the art and to propose a method in which expansion and change of length during the cold forming are avoided, and to produce gear components provided with inner teeth that have greater symmetry and higher accuracy.

This object is accomplished by a method for producing an inner contour with an internal arbor acting on the inside of a cup-shaped or annular rotationally symmetrical workpiece, by a rotating die as a workpiece mount that works together with the internal arbor during the cold forming. A workpiece provided with a press fit outside dimension or a prefabricated workpiece is inserted into the die and is pressed against the inner wall of the die with a tight frictional fit and is rotationally fixed with the rotationally driven internal arbor. The workpiece is then ejected after completion of the rolling process with an axial ram, with the internal arbor being cantilever-mounted and being advanced axially and radially during the rolling, The workpiece is preferably inserted into the die by longitudinal press-fitting and is pressed against the inner wall of the die by friction fit and rotationally fixed with the rotationally driven internal arbor during the cold forming.

The workpiece may be inserted into the die with heating or chilling, and is pressed against the inner wall of the die by friction fit and is rotationally fixed with the rotationally driven internal arbor during the cold forming.

In one embodiment, the workpiece, which is prefabricated on the outside, is inserted into a collet chuck-like die.

The internal arbor may be fed radially toward the workpiece mounted in the die before forming, and the internal profile is formed by feeding the internal arbor axially.

To produce internal gearing, the internal arbor may be provided with a slanted cutting face with a pressure angle at its end face to be introduced into the workpiece.

The rotationally driven internal arbor may be synchronized with the rotationally mounted die by a synchronizing disc that has a geared profile.

The die and the internal arbor have may have drive mechanisms independent of one another that are coupled by an electronic synchronization device to synchronize rotation and to maintain the engagement relationships between the internal arbor and the workpiece by control technology.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In, the drawings, wherein similar reference characters denote similar elements throughout the several views.

DETAILED DESCRIPTION OF THE PREFERRED EMBODIMENT

Figure 1:
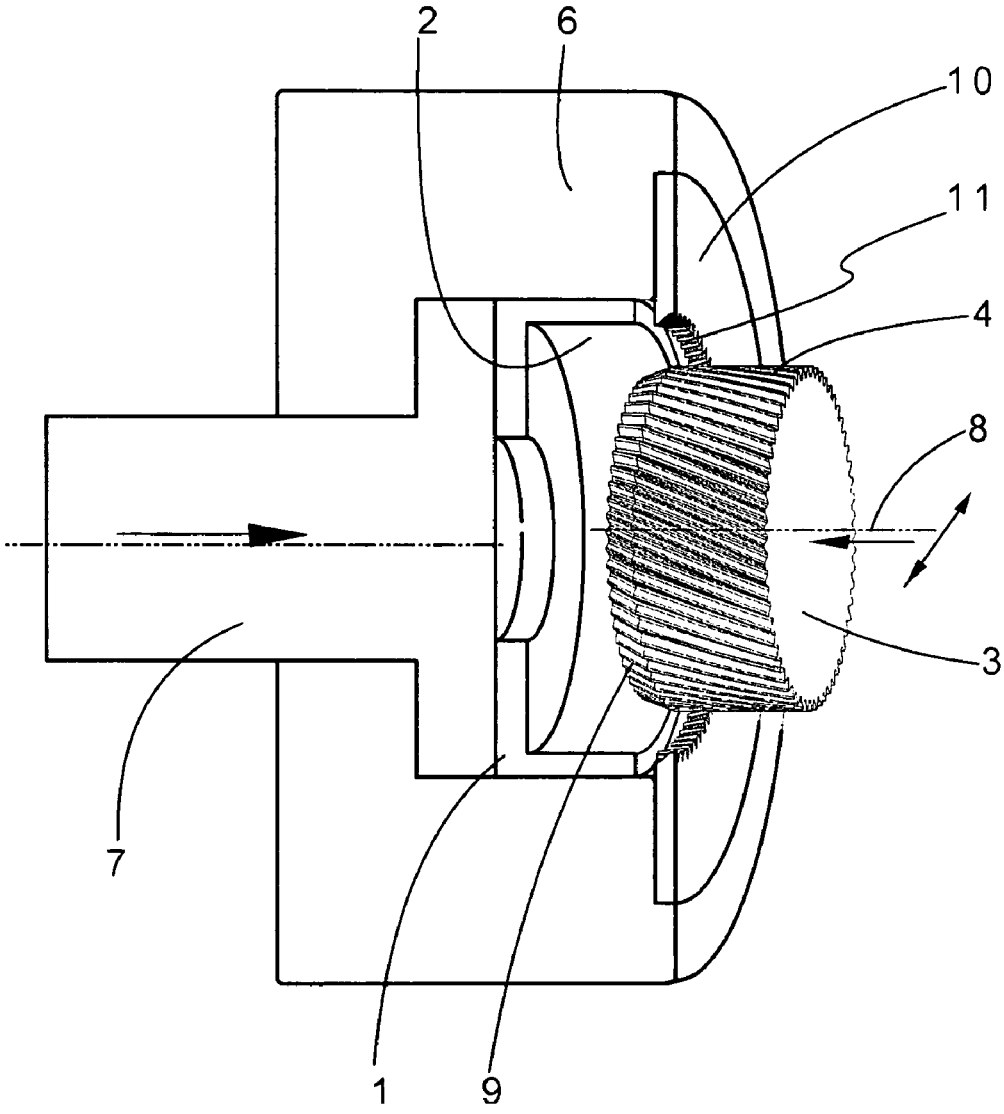
FIG. 1 shows a schematic view of rolling the inner teeth of a workpiece with a rotationally driven internal arbor according to the invention.

Referring now in detail to the drawings, FIG. 1 shows, very schematically, a rotationally symmetrical cup-shaped workpiece 1, in which the internal bore is to be provided with an internal contour 2 in the form of gear teeth. Workpiece 1 can likewise have an annular configuration. Preferred workpiece parts are ring gears, slip bushings, ratchet bushings, couplers, or gear components provided with internal teeth in the same way. In this embodiment, cup-shaped workpiece 1 is to be provided with internal gearing extending axially that has a helical slant angle. The profiling is accomplished with an internal arbor 3 acting on internal contour 2 or internal bore that is provided with profiling outer gearing 4 corresponding to the internal gearing. Internal arbor 3 has a rotationally driven arbor shaft 5 indicated in FIG. 2 that is carried on an arbor bearing, not shown further, with the internal arbor 3 being able to be shifted radially and axially.

Workpiece 1 is held during the cold forming in a rotating die 6 as the workpiece carrier that acts together with internal arbor 3. Workpiece 1 is prefabricated with an outside diameter fitted to the internal contour 2 of the die 6. Workpiece 1 is pressed into the die 6 by means of a longitudinal press fit. During the cold forming, workpiece 1 is pressed against the inner contour 2 of die 6 by the rotationally driven internal arbor 3. Workpiece 1 is thereby torsionally fixed frictionally in die 6. An axial ram 7 is provided in die 6 to eject workpiece 1 after the rolling process of profiling is completed, by which finished workpiece 1 is ejected in the axial direction after completion of its machining.

Workpiece 1 can be fastened in die 6 by longitudinal press-fitting, with the expense of prefabricating the outside diameter being necessary. To fasten workpiece 1 in die 6, the fit between the outside diameter of workpiece 1 and the inside diameter of die 6 must have an oversize. To make ejection with the axial ram 7 possible after forming, the oversized fit must not be too large. Consequently, small manufacturing tolerances are necessary. Simplification can be achieved by prefabrication of workpieces 1 in which the outside diameter is produced oversized. The tight frictional insertion of workpiece 1 in die 6 can be performed by heating or chilling with a workpiece 1 made oversized. Shape change occurring during the forming is eliminated by the prevailing state of stress in the course of workpiece material flow, so that workpiece 1 can be ejected directly from die 6 with axial ram 7.

To ensure secure clamping of an externally prefabricated workpiece 1, a collet chuck-like die 6 or die-like clamping device can also be used. With a collet chuck-like die 6, the workpiece can be changed in the machine more quickly and easily, and workpiece quality can be guaranteed with an externally prefabricated or profiled workpiece 1. This method can also make it possible to produce workpieces 1 profiled on the outside and inside.

According to FIG. 1, the production of a cup-shaped workpiece 1 with internal gear teeth starts, for example, with a deep-drawn part, a stamped part, or a blank made by machining, that is held by die 6, with workpiece 1 resting on and supported on the bottom face by the axial ram 7. Internal arbor 3 and workpiece 1 held in the die 6 are rolled on the contact surfaces with parallel axes. Material is displaced by reducing the axial spacing. The axial spacing is reduced by feeding in the radial direction, while the introduction of the cantilever-mounted internal arbor 3 into the internal bore of workpiece 1 requires axial feed.

Internal arbor 3 having outer gear teeth 4 or outer profiling is inserted axially into workpiece 1 when rotated around its arbor axis 8 during rolling and is fed in the radial direction. During rotation, internal arbor 3 gradually approaches workpiece 1 in the radial direction and is pressed into inner contour 2, with the volume of material thereby displaced flowing into the tooth spaces of internal arbor 3 to produce the tooth parts of the internal gear teeth. During the rolling and the radial feed of internal arbor 3, material builds up on the profile flanks of internal arbor 3 because of material displacement. As internal arbor 3 advances axially, material is displaced in the area of the head section of internal arbor 3. Consequently, no longitudinal variation can occur because workpiece 1 is enclosed by die 6 and its longitudinal extent is limited by axial ram 7. The material displacement is completely transferred to the profile form of workpiece 1 during the cold rolling by the high pressure of the internal arbor 3. Faults in the crown area of the formed workpiece teeth can be avoided. Precision parts with inner teeth can thus be produced simply and economically by this method. Substantially better work results are produced because unwanted form changes of workpiece 1 are avoided despite the high deformation forces.

Figure 2:
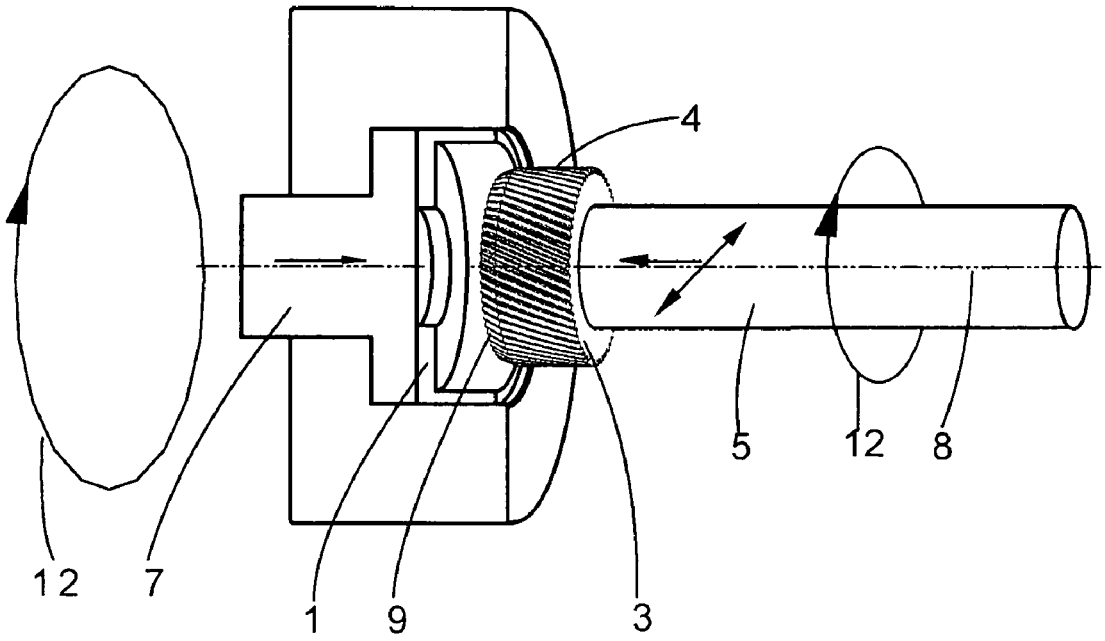
FIG. 2 shows a schematic view of rolling the inner teeth of a workpiece with a rotationally driven internal arbor and a driven die according to the invention.

With the method described in FIG. 2, internal arbor 3 is first advanced radially toward the workpiece 1 mounted in the die 6 before forming. The inner profile is formed by advancing internal arbor 3 axially with rotation of internal arbor 3 around its own arbor axis 8. Despite the axial feed of internal arbor 3, material displacement takes place in the radial direction. Length change of workpiece 1 is completely avoided and development of the profile is improved. The pressure forces transferred by internal arbor 3 are accordingly utilized completely for profiling. The pressure forces of internal arbor 3 are reduced in this way and the service life of internal arbor 3 is lengthened.

To facilitate the insertion of internal arbor 3 and for further improvement of the profile deformation, internal arbor 3 at its front face to be inserted into workpiece 1 has a slanted section 9 with a pressure angle. The forces acting on workpiece 1 are smaller with an internal arbor 3 with a pressure angle. The teeth are gradually brought to the required depth in the area of this section 9 with the axial advance, because preforming occurs from section 9 before the development of the inner profile to specification, and the profile is gradually brought to its final form. This spares the edge zones of the arbor tools.

Producing the internal profile by deformation progressing essentially in the axial direction has the advantage that the material is induced with the attack of the first profile tooth to flow in the area of the base of the profile, with the internal profile being brought easily into its final form. This provides the benefit of smaller radial pressures. There is no danger that the material will harden in the profile base at the beginning of deformation and will become brittle from increasing hardening. The workpiece profile that is formed has higher load capacity because of this.

In the method according to FIG. 1, internal arbor 3 is driven in rotation. Internal arbor 3 drives workpiece 1, and undriven die 6 with the firmly clamped workpiece 1 is entrained by workpiece 1. Internal arbor 3 and workpiece 1 roll on one another in the contact zone. This provides continuous machining in the circumferential direction. When rolling gear teeth, to prevent the teeth initially rolled during the rolling process from being over-rolled, synchronization of the rolling process is necessary so that the desired pitch prevails at the conclusion.

To synchronize the engagement of the inner profile with outside gearing 4 of internal arbor 3, a synchronizing disc 10 that has a toothed profile is placed in front of die 6. Synchronization is provided for by the form-fitting engagement of internal arbor 3 with the synchronizing disc 10 until the profile depth required for guidance of internal arbor 3 is reached. The synchronizing disc 10 is provided with internal gearing 11. Pitch errors are avoided in this way.

In the method according to FIG. 2, die 6 and internal arbor 3 have drive mechanisms independent of one another indicated by rotational arrow 12, which are coupled with one another by control means to synchronize rotation, to maintain the engagement relationships between internal arbor 3 and workpiece 1 in the period of feeding. The drive mechanisms preferably comprise CNC-controlled electric motor drives that are synchronized by an electronic synchronizing device. In this way, pitch errors are avoided. Speed-controlled three-phase synchronous motors provided with control-loop circuits can be used for individual drives of die 6 and internal arbor 3, that are analog or digitally controlled, and by constant comparison of setpoints and actual values of current and speed provide for the drives to comply exactly with the desired motions even with varying load. Workpiece 1 can be produced with exact spacing of teeth by appropriate CNC control for the exact synchronization of the drive for die 6 and internal arbor 3.

Accordingly, while only a few embodiments of the present invention have been shown and described, it is obvious that many changes and modifications may be made thereunto without departing from the spirit and scope of the invention.

What is claimed is:

1. A method for producing an inner contour with an internal arbor acting on an inside of a cup-shaped or annular rotationally symmetrical workpiece that is carried by a rotating die as a workpiece mount that works together with the internal arbor during cold flow forming, comprising:

inserting a workpiece provided with a press fit outside dimension or a prefabricated workpiece into the die;

pressing the workpiece against an inner wall of the die with a tight frictional fit and rotationally fixed with the internal arbor;

rotating the internal arbor against the workpiece to create the inner contour in a rolling process; and ejecting the workpiece after completion of the rolling process with an axial ram, wherein the internal arbor has a cylindrically outside profiling with a slanted entrance bevel section (9) with a pressure angle and is cantilever-mounted and is advanced axially and radially during the rolling process.

2. The method pursuant to claim 1, wherein the workpiece is prefabricated with a press fit in the outside diameter and is inserted into the die by longitudinal press-fitting and is pressed against the inner wall of the die by friction fit.

3. The method according to claim 1, wherein the workpiece is prefabricated with an oversize outside diameter that exceeds the diameter of the die and is inserted into the die via heating the die or chilling the workpiece.

4. The method according to claim 1, wherein the workpiece is prefabricated on the outside and wherein the die is a collet chuck-like die.

5. The method according to claim 1, wherein the internal arbor is fed radially toward the workpiece mounted in the die before forming the inner contour, and the inner contour is formed by feeding the internal arbor axially.

6. The method pursuant to claim 1, wherein the internal arbor has a slanted cutting face with a pressure angle at its end face to be introduced into the workpiece.

7. The method pursuant to claim 1, wherein the internal arbor is synchronized with the die by a synchronizing disc that has a geared profile.

8. The method pursuant to claim 1, wherein the die and the internal arbor have drive mechanisms independent of one another, said drive mechanisms being coupled by an electronic synchronization device to synchronize rotation and to maintain engagement relationships between the internal arbor and the workpiece by control technology.

* * * * *